US007117780B2

(12) United States Patent
Cohen

(10) Patent No.: US 7,117,780 B2
(45) Date of Patent: Oct. 10, 2006

(54) COMPOSITE ARMOR PLATE

(76) Inventor: Michael Cohen, Kibbutz Kfar Etzion, Mobile Post North Yehuda, 90200 (IL)

( * ) Notice: Subject to any disclaimer, the term of this patent is extended or adjusted under 35 U.S.C. 154(b) by 81 days.

(21) Appl. No.: 10/913,591

(22) Filed: Aug. 5, 2004

(65) Prior Publication Data

US 2005/0072294 A1 Apr. 7, 2005

(30) Foreign Application Priority Data

Aug. 26, 2003 (IL) ..... 157584

(51) Int. Cl.
*F41H 5/02* (2006.01)

(52) U.S. Cl. ..... 89/36.02; 89/36.08; 89/36.04

(58) Field of Classification Search ..... 89/36.01, 89/36.02, 36.05, 36.07, 36.08
See application file for complete search history.

(56) References Cited

U.S. PATENT DOCUMENTS

| | | | | |
|---|---|---|---|---|
| 3,705,558 | A * | 12/1972 | McDougal et al. | 109/84 |
| 4,061,815 | A | 12/1977 | Poole | |
| 4,529,640 | A | 7/1985 | Brown | |
| 4,534,266 | A | 8/1985 | Huet | |
| 4,836,084 | A | 6/1989 | Vogelesang | |
| 4,945,814 | A | 8/1990 | Huet | |
| 5,361,678 | A | 11/1994 | Roopchand | |
| 5,763,818 | A | 6/1998 | Guymon | |
| 5,972,819 | A | 10/1999 | Cohen | |
| 6,112,635 | A | 9/2000 | Cohen | |
| 6,203,908 | B1 | 3/2001 | Cohen | |
| 6,289,781 | B1 | 9/2001 | Cohen | |
| 6,408,734 | B1 | 6/2002 | Cohen | |
| 6,497,966 | B1 | 12/2002 | Cohen | |
| 6,892,623 | B1 * | 5/2005 | Benyami et al. | 89/36.02 |
| 2004/0020353 | A1 * | 2/2004 | Ravid et al. | 89/36.02 |

FOREIGN PATENT DOCUMENTS

| | | |
|---|---|---|
| EP | 0843149 A1 | 5/1998 |
| FR | 2711782 | 5/1995 |
| GB | 1352418 | 5/1974 |
| GB | 1081464 | 8/1976 |
| GB | 2272272 | 5/1994 |
| WO | WO 99/60327 | 11/1999 |

* cited by examiner

*Primary Examiner*—J. Woodrow Eldred
(74) *Attorney, Agent, or Firm*—Fulbright & Jaworski L.L.P.

(57) ABSTRACT

The invention provides a composite armor plate for absorbing and dissipating kinetic energy from high-velocity projectiles, the plate comprising a single internal layer of pellets which are bound and retained in plate form by an elastic material, substantially internally within the elastic material, such that the pellets are bound in a plurality of spaced-apart rows and columns, the pellets being made of a material selected from the group consisting of ceramic material glass and sintered refractory material, and the pellets being substantially fully embedded in the elastic material so that the pellets form an internal layer, characterized in that a majority of each of the pellets in direct contact with four diagonally-adjacent pellets in the same layer to provide mutual lateral confinement therebetween and is retained in spaced-apart relationship relative to pellets in the same row and pellets in the same column by the elastic material.

17 Claims, 2 Drawing Sheets

COMPOSITE ARMOR PLATE

The present invention relates to a ceramic body for deployment in a composite armor panel, for absorbing and dissipating kinetic energy from projectiles and for ballistic armor panels incorporating the same. More particularly, the invention relates to improved ceramic bodies for use in armored plates for providing ballistic protection for personnel as well as for light and heavy mobile equipment and for vehicles against high-velocity, armor-piercing projectiles or fragments.

The present invention is a modification of the inventions described in U.S. Pat. Nos. 5,763,813; 6,289,781; 6,112,635 and 6,203,908 and in WO-A-9815796 the relevant teachings of which are incorporated herein by reference.

In U.S. Pat. No. 5,763,813 there is described and claimed a composite armor material for absorbing and dissipating kinetic energy from high velocity, armor-piercing projectiles, comprising a panel consisting essentially of a single internal layer of high density ceramic pellets said pellets having an $Al_2O_3$ content of at least 93% and a specific gravity of at least 2.5 and retained in panel form by a solidified material which is elastic at a temperature below 250° C.; the majority of said pellets each having a part of a major axis of a length of in the range of about 3–12 mm, and being bound by said solidified material in plurality of superposed rows, wherein a majority of each of said pellets is in contact with at least 4 adjacent pellets, the weight of said panel does not exceed 45 kg/m$^2$.

In U.S. Pat. No. 6,112,635 there is described and claimed a composite armor plate for absorbing and dissipating kinetic energy from high velocity, armor-piercing projectiles, said plate consisting essentially of a single internal layer of high density ceramic pellets which are directly bound and retained in plate form by a solidified material such that the pellets are bound in a plurality of adjacent rows, wherein the pellets have an $Al_2O_3$ content of at least 93% and a specific gravity of at least 2.5, the majority of the pellets each have at least one axis of at least 12 mm length said one axis of substantially all of said pellets being in substantial parallel orientation with each other and substantially perpendicular to an adjacent surface of said plate and wherein a majority of each of said pellets is in direct contact with 6 adjacent pellets, and said solidified material and said plate are elastic.

In WO-A-9815796 there is described and claimed a ceramic body for deployment in a composite armor panel, said body being substantially cylindrical in shape, with at least one convexly curved end face, wherein the ratio D/R between the diameter D of said cylindrical body and the radius R of curvature of said at least one convexly curved end face is at least 0.64:1.

In U.S. Pat. No. 6,289,781 there is described and claimed a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, characterized in that the pellets have a specific gravity of at least 2 and are made of a material selected from the group consisting of glass, sintered refractory material, ceramic material which does not contain aluminum oxide and ceramic material having an aluminum oxide content of not more than 80%, the majority of the pellets each have at least one axis of at least 3 mm length and are bound by said solidified material in said single internal layer of adjacent rows such that each of a majority of said pellets is in direct contact with at least six adjacent pellets in the same layer to provide mutual lateral confinement therebetween, said pellets each have a substantially regular geometric form and said solidified material and said plate are elastic.

The teachings of all of these specifications are incorporated herein by reference.

There are four main considerations concerning protective armor panels. The first consideration is weight. Protective armor for heavy but mobile military equipment, such as tanks and large ships, is known. Such armor usually comprises a thick layer of alloy steel, which is intended to provide protection against heavy and explosive projectiles. However, reduction of weight of armor, even in heavy equipment, is an advantage since it reduces the strain on all the components of the vehicle. Furthermore, such armor is quite unsuitable for light vehicles such as automobiles, jeeps, light boats, or aircraft, whose performance is compromised by steel panels having a thickness of more than a few millimeters, since each millimeter of steel adds a weight factor of 7.8 kg/m$^2$.

Armor for light vehicles is expected to prevent penetration of bullets of any type, even when impacting at a speed in the range of 700 to 1000 meters per second. However, due to weight constraints it is difficult to protect light vehicles from high caliber armor-piercing projectiles, e.g. of 12.7 and 14.5 mm, since the weight of standard armor to withstand such projectile is such as to impede the mobility and performance of such vehicles.

A second consideration is cost. Overly complex armor arrangements, particularly those depending entirely on synthetic fibers, can be responsible for a notable proportion of the total vehicle cost, and can make its manufacture non-profitable.

A third consideration in armor design is compactness. A thick armor panel, including air spaces between its various layers, increases the target profile of the vehicle. In the case of civilian retrofitted armored automobiles which are outfitted with internal armor, there is simply no room for a thick panel in most of the areas requiring protection.

A fourth consideration relates to ceramic plates used for personal and light vehicle armor, which plates have been found to be vulnerable to damage from mechanical impacts caused by rocks, falls, etc.

Fairly recent examples of armor systems are described in U.S. Pat. No. 4,836,084, disclosing an armor plate composite including a supporting plate consisting of an open honeycomb structure of aluminum; and U.S. Pat. No. 4,868,040, disclosing an antiballistic composite armor including a shock-absorbing layer. Also of interest is U.S. Pat. No. 4,529,640, disclosing spaced armor including a hexagonal honeycomb core member.

Other armor plate panels are disclosed in British Patents 1,081,464; 1,352,418; 2,272,272, and in U.S. Pat. No. 4,061,815 wherein the use of sintered refractory material, as well as the use of ceramic materials, are described.

As stated in U.S. Pat. No. 5,763,813 there are described and claimed armor panels comprising pellets in contact with at least 4 adjacent pellets.

In later U.S. Pat. Nos. 6,112,635 and 6,289,781 there are described and claimed armor panels comprising pellets in direct contact with 6 adjacent pellets as shown in Figures therein.

When one thinks of the arrangement contemplated by U.S. Pat. No. 5,763,813 one normally visualizes a simple array of rows and columns such as seen with regard to one of the layers described in prior art U.S. Pat. No. 3,523,057 which results in the fact that a majority of the pellets are in direct contact with 4 adjacent pellets.

In said prior art patent however, the pellets are cast into the flexible matrix to a depth of only ¼ of the diameter resulting in the fact that when projectiles are fired at such a plate the pellets are readily displaced from the matrix and said panel does not have multi-hit capability.

On the other hand, the arrangement as described in U.S. Pat. No. 5,763,813 wherein the pellets are arranged as a substantially single internal layer within the solidified matrix material, results in the fact that when ballistic testing was carried out on such an array in a panel consisting essentially of a single internal layer of high density ceramic pellets which panel had a size of 10×12 inches and which was prepared according to claim 1 of the patent wherein a majority of said pellets is in contact with at least four adjacent pellets, said panel was found to have a multi-hit capacity of withstanding seven out of eight projectiles fired at a range of 45 feet, wherein only one out of eight projectiles penetrated the plate.

When a comparable test was carried out on a panel having the same pellets however wherein the pellets were arranged so that a majority of each of said pellets is in direct contact with 6 adjacent pellets, none of the fourteen projectiles fired penetrated the plate.

Thus, while U.S. Pat. No. 5,763,813 provided a panel with multi-hit capacity vastly superior to that provided by any comparable weight prior art armor, nevertheless 1 out of 8 projectiles did penetrate the same while when utilizing the preferred array of pellets in direct contact with 6 adjacent pellets, no projectiles penetrated the array even when the number of fired projectiles was increased beyond 8.

As will be realized however, the more compact array of pellets in direct contact with 6 adjacent pellets has a greater weight per square foot or meter than does an array wherein each pellet is in contact with only 4 adjacent pellets.

It has now however surprisingly been found that it is possible to obtain the stopping power obtained with the arrangements involving contact with 6 adjacent pellets using an array wherein the majority of pellets are in contact with only 4 adjacent pellets.

More specifically according to the present invention there is now provided a composite armor plate for absorbing and dissipating kinetic energy from high-velocity projectiles, said plate comprising a single internal layer of pellets which are bound and retained in plate form by an elastic material substantially internally within said elastic material, such that the pellets are bound in a plurality of rows and columns, with at least one of said rows and columns being spaced apart, the other of said rows and columns being in contact, said pellets being made of a material selected from the group consisting of ceramic material glass and sintered refractory material, and said pellets being substantially fully embedded in the elastic material so that the pellets form an internal layer, characterized in that a majority of each of said pellets in direct contact with four diagonally-adjacent pellets in the same layer to provide mutual lateral confinement therebetween and is retained in spaced-apart relationship relative to pellets in the same row and pellets in the same column by said elastic material.

The armor plates described in EP-A-0843149 and European patent application 98301769.0 are made using ceramic pellets made substantially entirely of aluminum oxide. In WO-A-9815796 the ceramic bodies are of substantially cylindrical shape having at least one convexly-curved end-face, and are preferably made of aluminum oxide.

In WO 99/60327 it was described that the improved properties of the plates described in the earlier patent applications of this series is as much a function of the configuration of the pellets, which are of regular geometric form with at least one convexly-curved end face (for example, the pellets may be spherical or ovoidal, or of regular geometric cross-section, such as hexagonal, with at least one convexly-curved end face), said panels and their arrangement as a single internal layer of pellets bound by an elastic solidified material, wherein each of a majority of said pellets is in direct contact with at least four adjacent pellets and said curved end face of each pellet is oriented to substantially face in the direction of an outer impact-receiving major surface of the plate. As a result, said specification teaches that composite armor plates superior to those available in the prior art can be manufactured using pellets made of sintered refractory materials or ceramic materials having a specific gravity below that of aluminum oxide, e.g., boron carbide with a specific gravity of 2.45, silicon carbide with a specific gravity of 3.2 and silicon aluminum oxynitride with a specific gravity of about 3.2.

Thus, it was described in said publication that sintered oxides, nitrides, carbides and borides of magnesium, zirconium, tungsten, molybdenum, titanium and silica can be used and especially preferred for use in said publication and also in the present invention the ceramic bodies utilized herein are formed of a ceramic material selected from the group consisting of sintered oxide, nitrides, carbides and borides of alumina, magnesium, zirconium, tungsten, molybdenum, titanium and silica.

All of these features are incorporated herein as preferred embodiments of the present invention.

More particularly, the present invention relates to a ceramic body as defined for absorbing and dissipating kinetic energy from high velocity armor piercing projectiles, wherein said body is made of a material selected from the group consisting of alumina, boron carbide, boron nitride, titanium diboride, silicon carbide, silicon oxide, silicon nitride, magnesium oxide, silicon aluminum oxynitride and mixtures thereof.

In U.S. Ser. No. 09/924745 there is described and claimed a composite armor plate for absorbing and dissipating kinetic energy from high velocity projectiles, said plate comprising a single internal layer of pellets which are directly bound and retained in plate form by a solidified material such that the pellets are bound in a plurality of adjacent rows, said pellets having a specific gravity of at least 2 and being made of a material selected from the group consisting of glass, sintered refractory material and ceramic material, the majority of the pellets each having at least one axis of at least 3 mm length and being bound by said solidified material in said single internal layer of adjacent rows such that each of a majority of said pellets is in direct contact with six adjacent pellets in the same layer to provide mutual lateral confinement therebetween, said pellets each having a substantially regular geometric form, wherein said solidified material and said plate are elastic, characterized in that a channel is provided in each of a plurality of said pellets, substantially opposite to an outer impact-receiving major surface of said plate, thereby reducing the weight per area of each of said pellets.

In preferred embodiments described therein each of said channels occupies a volume of up to 25% within its respective pellet.

Said channels can be bored into preformed pellets or the pellets themselves can be pressed with said channel already incorporated therein.

The teachings of said specification are also incorporated herein by reference.

Thus, in preferred embodiments of the present invention a channel is provided in the pellets of the armor of the present invention to further reduce the weight per area thereof and preferably said channel occupies a volume of up to 25% of said body.

In accordance with the present invention said channels are preferably of a shape selected from the group consisting of cylindrical, pyramidal, hemispherical and quadratic, hexagonal prism and combinations thereof.

As is known, there exists a ballistic effect known in the art in which a projectile striking a cylinder at an angle has a tendency to move this cylinder out of alignment causing a theoretical possibility that a second shot would have more penetration effect on a panel.

As will be realized, since material is removed from the pellets of the present invention their weight is decreased, as is the overall weight of the entire composite armor plate from which they are formed, thereby providing the unexpected improvement of reduced weight of protective armor panels without loss of stopping power, as shown in the examples hereinafter.

In preferred embodiments of the present invention said pellets each have a major axis and said pellets are arranged with their major axes substantially parallel to each other and oriented substantially perpendicularly relative to said outer impact-receiving major surface of said panel.

Thus, in preferred embodiments of the present invention there is provided a composite armor plate as herein defined, wherein a majority of said pellets have at least one convexly-curved end face oriented to substantially face in the direction of an outer impact receiving major surface of said plate.

In especially preferred embodiments of the present invention said pellets have at least one circular cross-section, said pellets being oriented so that said circular cross-section is substantially parallel with an outer impact receiving major surface of said plate.

In other preferred embodiments of the present invention said pellets have at least one hexagonal cross-section, said pellets being oriented so that said hexagonal cross-section is substantially parallel with an outer impact receiving major surface of said plate.

The solidified material can be any suitable material, such as aluminum, a thermoplastic polymer such as polycarbonate, or a thermoset plastic such as epoxy.

In French Patent 2,711,782, there is described a steel panel reinforced with ceramic materials; however said panel does not have the ability to deflect armor-piercing projectiles unless a thickness of about 8–9 mm of steel is used, which adds undesirable excessive weight to the panel and further backing is also necessary thereby further increasing the weight thereof.

According to a further aspect of the invention, there is provided a multi-layered armor panel, comprising an outer, impact-receiving layer formed by a composite armor plate as hereinbefore defined for deforming and shattering an impacting high velocity projectile; and an inner layer adjacent to said outer layer and, comprising an elastic material for absorbing the remaining kinetic energy from said fragments. Said elastic material will be chosen according to cost and weight considerations and can be made of any suitable material, such as aluminum or woven or non-woven textile material.

In especially preferred embodiments of the multi-layered armor panel, the inner layer adjacent to said outer layer comprises a tough woven textile material for causing an asymmetric deformation of the remaining fragments of said projectile and for absorbing the remaining kinetic energy from said fragments, said multi-layered panel being capable of stopping three projectiles fired sequentially at a triangular area of said multi-layered panel, wherein the height of said triangle is substantially equal to three times the length of the axis of said pellets.

As described, e.g., in U.S. Pat. No. 5,361,678, composite armor plate comprising a mass of spherical ceramic balls distributed in an aluminum alloy matrix is known in the prior art. However, such prior art composite armor plate suffers from one or more serious disadvantages, making it difficult to manufacture and less than entirely suitable for the purpose of defeating metal projectiles. More particularly, in the armor plate described in said patent, the ceramic balls are coated with a binder material containing ceramic particles, the coating having a thickness of between 0.76 and 1.5 mm and being provided to help protect the ceramic cores from damage due to thermal shock when pouring the molten matrix material during manufacture of the plate. However, the coating serves to separate the harder ceramic cores of the balls from each other, and will act to dampen the moment of energy which is transferred and hence shared between the balls in response to an impact from a bullet or other projectile. Because of this and also because the material of the coating is inherently less hard than that of the ceramic cores, the stopping power of a plate constructed as described in said patent is not as good, weight for weight, as that of a plate in accordance with the present invention.

U.S. Pat. No. 3,705,558 discloses a lightweight armor plate comprising a layer of ceramic balls. The ceramic balls are in contact with each other and leave small gaps for entry of molten metal. In one embodiment, the ceramic balls are encased in a stainless steel wire screen; and in another embodiment, the composite armor is manufactured by adhering nickel-coated alumina spheres to an aluminum alloy plate by means of a polysulfide adhesive. A composite armor plate as described in this patent is difficult to manufacture because the ceramic spheres may be damaged by thermal shock arising from molten metal contact. The ceramic spheres are also sometimes displaced during casting of molten metal into interstices between the spheres.

In order to minimize such displacement, U.S. Pat. Nos. 4,534,266 and 4,945,814 propose a network of interlinked metal shells to encase ceramic inserts during casting of molten metal. After the metal solidifies, the metal shells are incorporated into the composite armor. It has been determined, however, that such a network of interlinked metal shells substantially increases the overall weight of the armored panel and decreases the stopping power thereof.

It is further to be noted that U.S. Pat. No. 3,705,558 suggests and teaches an array of ceramic balls disposed in contacting pyramidal relationship, which arrangement also substantially increases the overall weight of the armored panel and decreases the stopping power thereof, due to a billiard-like effect upon impact.

An incoming projectile may contact the pellet array in one of three ways:

1. Center contact. The impact allows the full volume of the pellet to participate in stopping the projectile, which cannot penetrate without pulverizing the whole pellet, an energy-intensive task. The pellets used are preferably of circular or hexagonal cross-section or other regular geometric shapes having at least one convexly-curved end face, said end face being oriented to substantially face in the direction of an outer impact receiving major surface of said plate.

2. Flank contact. The impact causes projectile yaw, thus making projectile arrest easier, as a larger frontal area is contacted, and not only the sharp nose of the projectile. The projectile is deflected sideways and needs to form for itself a large aperture to penetrate, thus allowing the armor to absorb the projectile energy.
3. Valley contact. The projectile is jammed, usually between the flanks of three pellets, all of which participate in projectile arrest. The high side forces applied to the pellets are resisted by the pellets adjacent thereto as held by the substrate or plate, and penetration is prevented.

The present invention also provides a method for producing a composite armor plate as defined hereinabove, comprising providing a mold having a bottom, two major surfaces, two minor surfaces and an open top, wherein the distance between said two major surfaces is from about 1.1 to about 1.4 times the height of said pellets; inserting a first bottom row of said pellets into said mold in spaced apart relationship as shown with reference to FIG. 2 to form a first row of pellets and then adding further pellets to form a plurality of superposed rows of pellets extending substantially along the entire distance between said minor side surfaces, and from said bottom substantially to said open top; wherein due to the spacing between the pellets of the first bottom row, each subsequent superposed row is also formed with a spaced apart relationship between pellets of the same row and then incrementally heating said mold and the pellets contained therein to a temperature of at least 100° C. above the flow point of the material to be poured in the mold; pouring molten material into said mold to fill the same; allowing said molten material to solidify; and removing said composite armor plate from said mold.

As will be realized, when preparing the composite armor plate of the present invention, said pellets do not necessarily have to be completely covered on both sides by said solidified material, and the term internal layer as used herein is intended to denote that the pellets are either completely or almost completely covered by said solidified material, wherein outer face surfaces of the plate are formed from the solidified material, the plate having an outer impact receiving face, at which face each pellet is either covered by the solidified material, touches said solidified material which forms surfaces of said outer impact receiving face or, not being completely covered by said solidified material which constitutes surfaces of said outer impact receiving face, bulges therefrom, the solidified material and hence the plate being elastic.

The invention will now be described in connection with certain preferred embodiments with reference to the following illustrative figures so that it may be more fully understood.

With reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
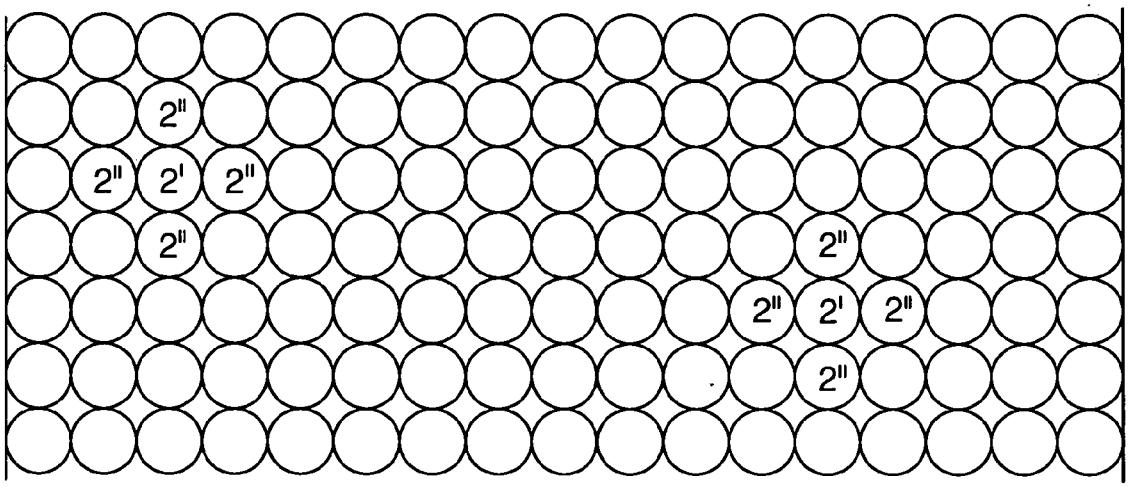
Fig.1. Prior art
FIG. 1 is a cross-sectional view of an arrangement of pellets according to the prior art.

Referring to FIG. 1 there is seen a cross-sectional view of an arrangement of pellets 2 according to the prior art wherein each pellet 2' is in direct contact with four adjacent pellets 2" said pellets 2" being in the same row and in the same column as said pellet 2'.

Figure 2:
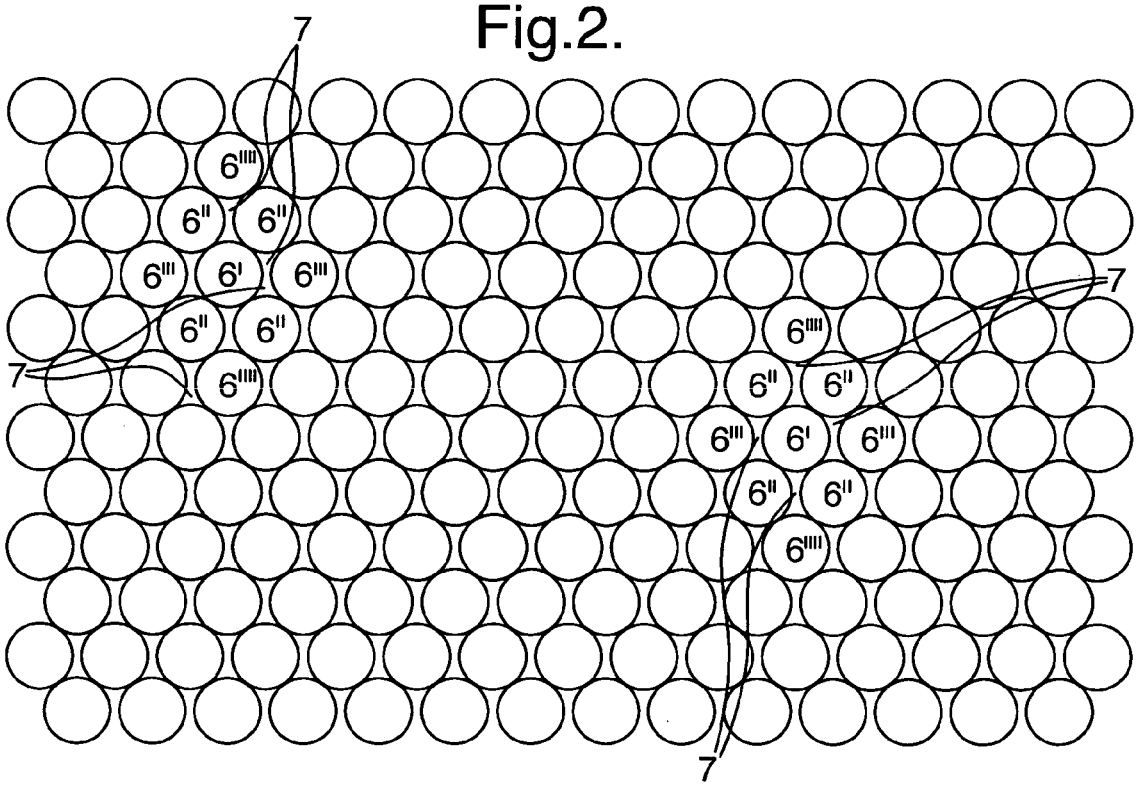
FIG. 2 is a cross-sectional view of an arrangement of pellets according to the present invention.

Referring to FIG. 2 there is seen a cross-sectional view of an arrangement of pellets 6 according to the present invention wherein each pellet 6' is in direct contact with four adjacent pellets 6", however wherein the arrangement is such that a majority of each of said pellets is in direct contact with four diagonally-adjacent pellets in the same layer to provide mutual lateral confinement therebetween and is retained in spaced-apart relationship relative to pellets 6'" in the same row and pellets 6"" in the same column by said elastic material 7.

Figure 3:
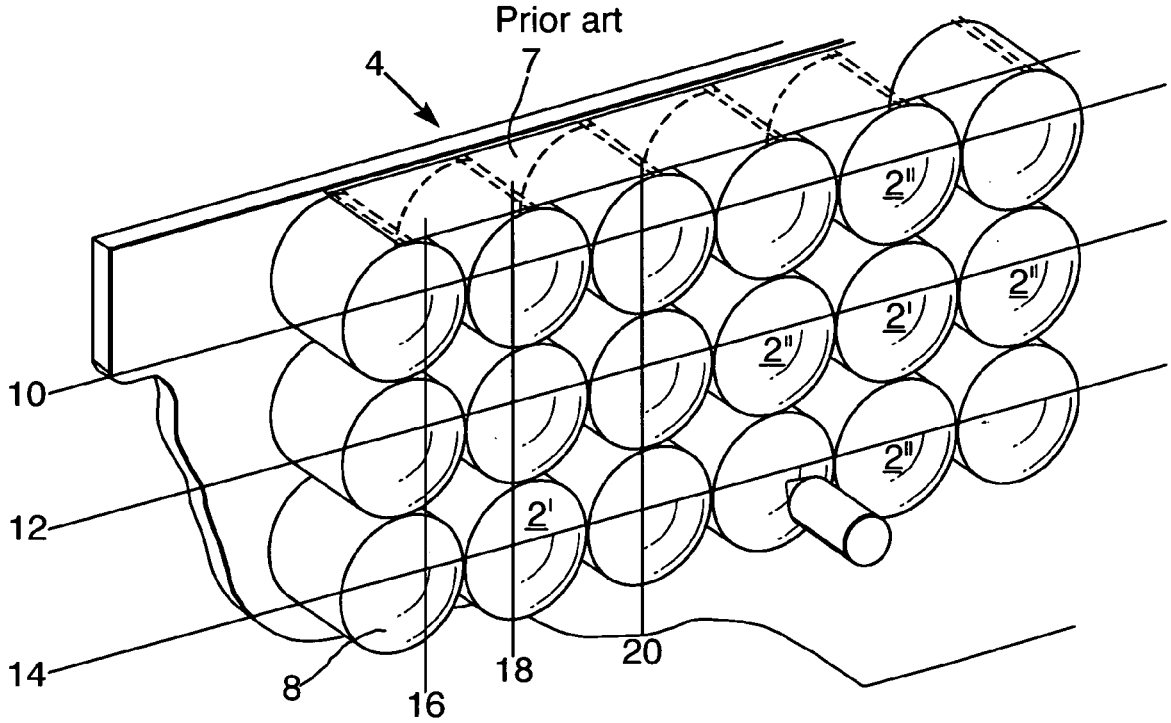
Fig.3. Prior art
FIG. 3 is a perspective view of a small section of an embodiment of an armor panel according to the prior art.

Referring to FIG. 3 there is seen a perspective view of pellets 2 for use in a composite armor plate 4 of the same type as described and claimed in U.S. Pat. Nos. 5,763,813 and 6,289,781, the relevant teachings of which are incorporated herein by reference, comprising a single internal layer of ceramic pellets, which pellets are bound in a single layer by solidified elastic resin material 7 and which pellets are substantially cylindrical with at least one convexly curved end face 8, said pellets being arranged in a single layer of adjacent rows 10, 12, 14, and columns 16, 18, 20, etc. wherein each of a majority of each of said pellets 2' is in direct contact with four adjacent pellets 2" said pellets 2" being in the same row and in the same column as said pellet 2'.

Figure 4:
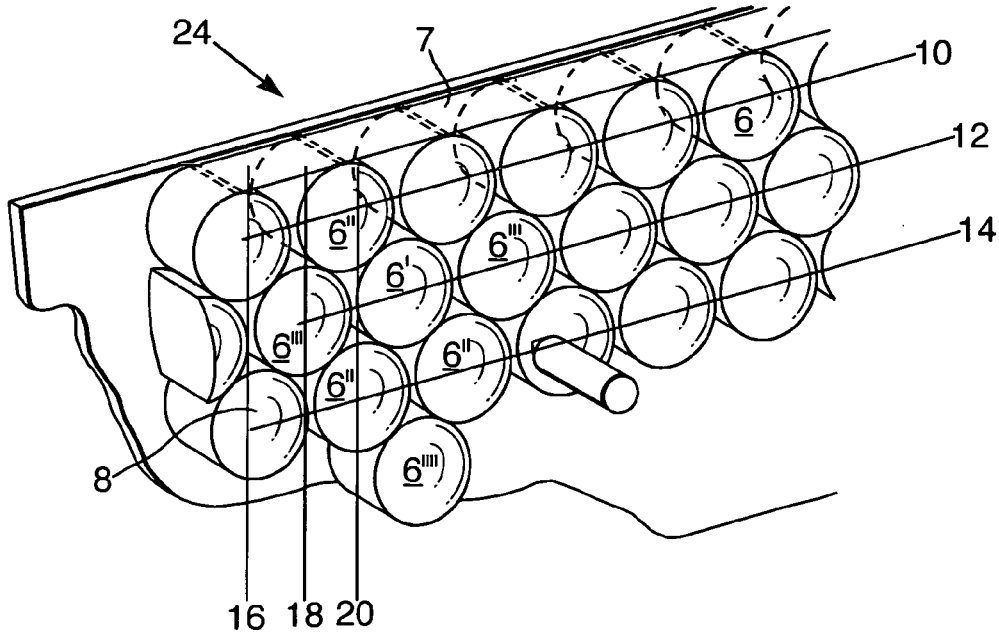
FIG. 4 is a perspective view of a small section of a preferred embodiment of an armor panel according to the present invention.

Referring to FIG. 4 there is seen a perspective view of pellets 6 for use in a composite armor plate 24 according to the present invention, comprising a single internal layer of ceramic pellets, which pellets are bound in a single layer by solidified elastic resin material 7 and which pellets are substantially cylindrical with at least one convexly curved end face 8, said pellets being arranged in a single layer of rows 10, 12, 14, and columns 16, 18, 20, etc. wherein each of a majority of each of said pellets 6' is in direct contact with four diagonally-adjacent pellets 6" in the same layer to provide mutual lateral confinement therebetween and is retained in spaced-apart relationship relative to pellets 6'" in the same row and pellets 6"" in the same column 18 by said elastic material 7.

The pellets 6, 6', 6", 6'" and 6"" are all formed of a ceramic material. Preferred ceramics are sintered oxide, nitrides, carbides and borides of alumina, magnesium, zirconium, tungsten, molybdenum, titanium and silica.

Where the pellet is intended to be used for absorbing and dissipating kinetic energy from armor piercing projectiles, other materials are preferred. These materials are typically alumina, boron carbide, boron nitride, titanium diboride, silicon carbide, silicon oxide, silicon nitride, magnesium oxide, silicon aluminum oxynitride and mixtures thereof.

In order to establish the effectiveness of the arrangement of the pellets of the present invention and composite armor panels incorporating the same a panel was prepared with the size of 10×12 in. and ceramic bodies as shown in FIG. 4 and sent to the H.P. White Laboratory, Inc. in Maryland for ballistic resistance testing.

The description of the test and the results are set forth hereinafter.

As will be noted said panel having a weight of only 6.07 pounds provided exceptional multi-impact performance wherein none of the seven 7.62 mm armor piercing M61 projectiles and none of the three 5.56 mm projectiles fired at a distance of 45 feet from the target penetrated said panel.

As will be realized, other methods can also be used for preparing the composite armor plates of the present invention. In one such method there is provided a horizontal mold having a frame with a bottom, four sides and an open top. The pellets are arranged within the frame in an array as shown in FIG. 2 with a spaced apart relationship between pellets of the same row. If the panel is built using a polyurethane or epoxy material which is a cold system casting procedure, a room temperature molding cast is used. In the case of a matrix formed from soft aluminum, the panel containing the pellets is heated to a temperature of at least 100° C. above the flow point of the material to be poured into the mold, after which the molten material is poured into the mold and allowed to solidify whereafter upon cooling the formed composite armor plate is removed from the mold.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A composite armor plate for absorbing and dissipating kinetic energy from high-velocity projectiles, said plate comprising a single internal layer of pellets which are bound and retained in plate form by an elastic material, substantially internally within said elastic material, such that the pellets are bound in a plurality of rows and columns, at least one of said rows and columns being spaced apart, the other of said rows and columns being in contact, said pellets being made of a material selected from the group consisting of ceramic material glass and sintered refractory material, and said pellets being substantially fully embedded in the elastic material so that the pellets form an internal layer, characterized in that a majority of each of said pellets in direct contact with four adjacent pellets in the same layer to provide mutual lateral confinement therebetween and is retained in spaced-apart relationship relative to pellets in the same row and pellets in the same column by said elastic material.

2. A composite armor plate according to claim 1, wherein each of said pellets is farmed of a ceramic material selected from the group consisting of sintered oxide, nitrides, carbides and borides or alumina, magnesium, zirconium, tungsten, molybdenum, titanium and silica.

3. A composite armor plate according to claim 1, wherein each of said pellets is formed of a material selected from the group consisting of alumina, boron carbide, boron nitride, titanium diboride, silicon carbide, silicon oxide, silicon nitride, magnesium oxide, silicon aluminum oxynitride and mixtures thereof.

4. A composite armor plate according to claim 1, characterized in that a channel is provided in a plurality of said pellets to reduce the weight per area thereof.

5. A composite armor plate according to claim 4, wherein said channel occupies a volume of up to 25% of said pellet.

6. A composite armor plate according to claim 1, further comprising an inner layer adjacent said inner surface of said panel, said inner layer being formed from a plurality of adjacent layers, each layer comprising a plurality of unidirectional coplanar anti-ballistic fibers embedded in a polymeric matrix, the fibers of adjacent layers being at an angle of between about 45° to 90° to each other.

7. A composite armor plale according to claim 1, wherein a majority of said pellets have at least one convexly-curved end face oriented to substantially face in the direction of an outer impact receiving major surface of said plate.

8. A composite armor plate according to claim 1, wherein said pellets have at least one circular cross-section, said pellets being oriented so that said circular cross-section is substantially parallel with an outer impact receiving major surface of said plate.

9. A composite armor plate according to claim 1, wherein said pellets have at least one hexagonal cross-section, said pellets being oriented so that said hexagonal cross-section is substantially parallel with an outer impact receiving major surface of said plate.

10. An armor plate comprising a plurality of pellets and an elastic material in which the pellets are embedded, the pellets being arranged in a layer consisting of a plurality of parallel rows of pellets and a plurality of parallel columns of pellets, with the columns being substantially perpendicular to the rows, wherein at least one of said rows and columns are spaced from one another and the other of said rows and columns being in contact, wherein each of a majority of the pellets contacts two pellets in a first adjacent row and two pellets in a second adjacent row so tat each of a majority of the pellets is in contact with four, and four alone, adjacent pellets, and wherein for each row, the centres of adjacent pellets in said each row are spaced from one another substantially by a first distance and for each column the centres of adjacent pellets in said each column are spaced from one another substantially by a second distance, wherein the first distance is different from the second distance.

11. An armor plate according to claim 10, wherein one of said first and second distances is greater tan the other one of said first and second distances by a factor oat least 1.1

12. An armor plate according to claim 10, wherein each pellet has an axis generally perpendicular to said layer and has a circular cross-section in a plane perpendicular to said axis.

13. An armor plate according to claim 10, wherein the layer is planar.

14. An armor plate according to claim 10, wherein the pellets are entirely embedded or substantially entirely embedded in said elastic material.

15. An armor plate according to claim 10, wherein said layer of pellets is the only layer of pellets in said armor plate.

16. An armor plate according to claim 10, wherein the pellets are made of a ceramic material, glass or a sintered refractory material.

17. An armor plate according to claim 16, wherein the material of the pellets is directly in contact with said elastic material.

* * * * *